US005261428A

United States Patent [19]

Wu

[11] Patent Number: 5,261,428

[45] Date of Patent: Nov. 16, 1993

[54] HAIR FASTENING DEVICE

[76] Inventor: Fu Chi Wu, 17336 Chase St., Northridge, Calif. 91325

[21] Appl. No.: 682,062

[22] Filed: Apr. 8, 1991

Related U.S. Application Data

[63] Continuation-in-part of Ser. No. 568,981, Aug. 17, 1990, Pat. No. 5,082,011.

[51] Int. Cl.[5] ..... A45D 8/02

[52] U.S. Cl. ..... 132/281; 132/133; 132/282

[58] Field of Search ..... 132/273, 281, 282, 283, 132/276, 284, 127, 128, 101, 107, 127, 128, 132, 133, 144, 146, 161, 151, 145, 277

[56] References Cited

U.S. PATENT DOCUMENTS

| | | | |
|---|---|---|---|
| D. 154,205 | 6/1949 | Kovacs et al. | 132/133 |
| D. 180,713 | 7/1957 | Hammond | 132/139 |
| 701,479 | 6/1902 | Glass | 132/282 |
| 842,524 | 1/1907 | Cartwright | 132/281 |
| 958,339 | 5/1910 | Watson | 132/281 |
| 1,337,039 | 4/1920 | Bruder | 132/281 |
| 1,397,904 | 11/1921 | Rhein et al. | 132/281 |
| 1,429,712 | 9/1922 | Busby | 132/281 |
| 1,434,961 | 11/1922 | Noe . | |
| 1,714,358 | 4/1928 | Finkelstein . | |
| 1,834,153 | 12/1931 | Haims | 132/284 |
| 1,875,611 | 9/1932 | Jenkins | 132/281 |
| 2,159,709 | 5/1939 | Quetin | 132/133 |
| 2,171,422 | 8/1939 | Zaccaro et al. | 132/145 |
| 2,272,409 | 2/1942 | Johnson | 132/281 |
| 2,352,419 | 6/1944 | Van Housen, Jr. | 132/281 |
| 2,445,071 | 7/1948 | Kovacs et al. | 132/133 |
| 2,664,883 | 1/1954 | Smith | 132/281 |
| 2,718,894 | 9/1955 | Gresham et al. | 132/133 |
| 2,979,060 | 4/1961 | Reiner | 132/145 |
| 3,223,095 | 12/1965 | Seekings et al. | 132/277 |
| 3,330,287 | 7/1967 | Muhs | 132/281 |
| 3,362,052 | 1/1968 | Uchida | 132/277 |
| 3,568,687 | 3/1971 | Ciccone | 132/277 |
| 3,991,774 | 11/1976 | Wolfthal | 132/277 |

FOREIGN PATENT DOCUMENTS

| | | | |
|---|---|---|---|
| 481613 | 3/1952 | Canada . | |
| 6823 | 7/1904 | Denmark | 132/105 |
| 2303338 | 1/1972 | Fed. Rep. of Germany . | |
| 332899 | 11/1903 | France | 132/133 |
| 395897 | 3/1909 | France | 132/107 |
| 599815 | 1/1926 | France . | |
| 23836 | 12/1989 | United Kingdom | 132/281 |

OTHER PUBLICATIONS 3 photographs of embodiments known to the Applicant.

*Primary Examiner*—John J. Wilson
*Assistant Examiner*—Frank A. LaViola
*Attorney, Agent, or Firm*—Spensley Horn Jubas & Lubitz

[57] ABSTRACT

A toothed hair fastener having leaf-spring elements situated between one or more of the teeth of the fastener, and suitable for both thick and thin hair. Preferably, the leaf-springs are integrally formed as part of the toothed hair fastener.

11 Claims, 8 Drawing Sheets

HAIR FASTENING DEVICE

This application is a continuation-in-part of Ser. No. 07/568,981, filed Aug. 17, 1990, now U.S. Pat. No. 5,082,011.

BACKGROUND OF THE INVENTION

1. Field of the Invention

This invention relates to hair fastening devices, and more particularly to toothed hair fasteners including those having leaf-spring elements situated between the teeth of the device, and suitable for both thick and thin hair.

2. Related Art

Hair combs and related hair fastening devices, such as chignon pins, have traditionally been made with narrow-spaced teeth or prongs for use with thin hair, and with wide-spaced teeth for use with thick hair. Devices having narrow-spaced teeth are difficult to insert into thick hair, and devices having wide-spaced teeth tend to be easily dislodged when used in thin hair. Therefore, it has been common for merchants to maintain an inventory of both types of devices to accommodate hair of different thicknesses. Therefore, it would be desirable to provide a single type of hair fastening device that can be used with either thin or thick hair. The present invention provides such a device that can be easily and inexpensively manufactured.

SUMMARY OF THE DISCLOSURE

An embodiment of the invention comprises toothed hair fastening devices having leaf-springs situated between one or more of the teeth of the device. The leaf-springs are preferably integrally formed as part of each toothed hair fastening device.

The details of the preferred embodiment of the present invention are set forth in the accompanying drawings and the description below. Once the details of the illustrated embodiments of the invention are known, numerous additional innovations and changes will become obvious to one skilled in the art.

BRIEF DESCRIPTION OF THE DRAWINGS

Like reference numbers and designations in the drawings refer to like elements

DETAILED DESCRIPTION OF THE PREFERRED EMBODIMENTS

Throughout this description, the preferred embodiments and examples shown should be considered as exemplars, rather than limitations on the structure of the present invention.

Figure 1:
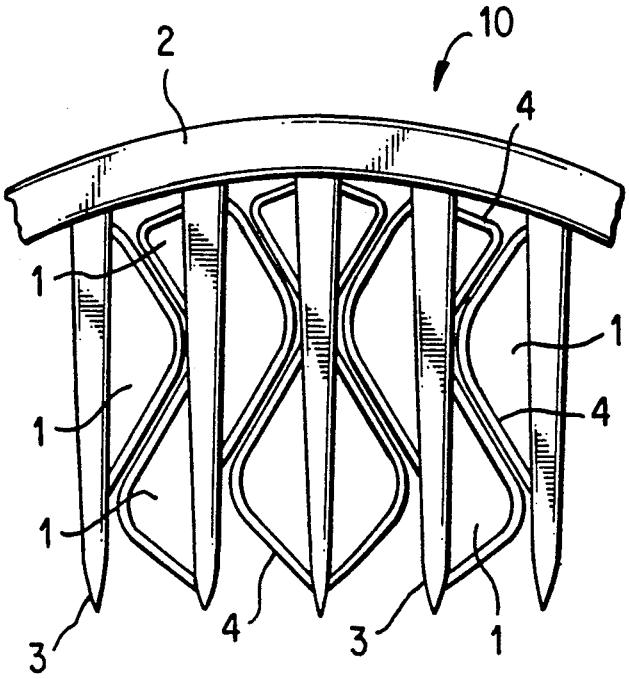
FIG. 1 is a front view of a curved-back hair comb according to an embodiment of the present invention.

FIG. 1 shows a front view of a curved-back hair comb 10 according to an embodiment of the present invention. The comb 10 includes a curved spine 2 having a number of projecting teeth 3. As is known in the art, the comb teeth 3 can be integrally formed with the back 2 of the comb 10, or separately manufactured and affixed thereto. The teeth 3 are generally, but not necessarily, parallel. Further, the teeth 3 may be straight, or curved (e.g., wavy) in any dimension.

Affixed at intervals to one or more of the teeth 3 are leaf-springs 4 formed of a resilient material, such as a flexible plastic. Each leaf-spring 4 is attached to its associated tooth 3 so as to leave open space between the leaf-spring 4 and the tooth 3. As shown in FIG. 1, leaf-springs 4 from adjacent teeth 3 are preferably designed to approximately conform to each other's shape. Such conformance leaves little or no gap between adjacent leaf-springs 4.

In the preferred embodiments of the invention, the leaf-springs 4 are integrally molded as part of the teeth 3. However, if desired, the leaf-springs 4 can be separately manufactured, and affixed to the teeth 3 in any desired fashion (for example, by heat welding, gluing, or ultrasonic bonding).

The purpose of the larger teeth 3 is to "split" relatively large groups of hair strands apart. Because the teeth 3 of the present invention are relatively widely spaced (comparable to the widely spaced teeth used for combs designed for thick hair), hair fastening devices designed in accordance with the present invention can be inserted into thick hair relatively easily.

As the teeth 3 of a comb 10 penetrate into a user's hair, each group of strands of the user's hair slides in between the leaf-springs 4, which are flexibly displaced during such insertion. The restorative spring force of adjacent leaf-springs 4 exerts a clamping force against the hair, and thus the leaf-springs 4 firmly clasp even thin hair.

Therefore, the stronger, more widely spaced teeth 3 of the comb 10 are used to initially penetrate hair, while the leaf-springs 4 are used to clamp the comb 10 to the hair and maintain the comb 10 in position after insertion.

Figure 2:
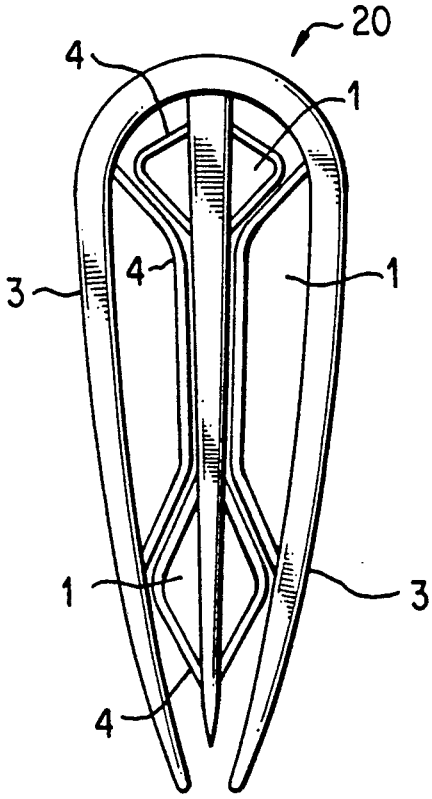
FIG. 2 is a front view of a hair fastening pin according to an embodiment of the present invention.

FIG. 2 shows an alternative comb o pin-like device 20 showing an alternative configuration of the teeth 3 and leaf-springs 4. The principle of operation of this device 20 is the same as the curved-back comb 10 in FIG. 1.

Figure 3:
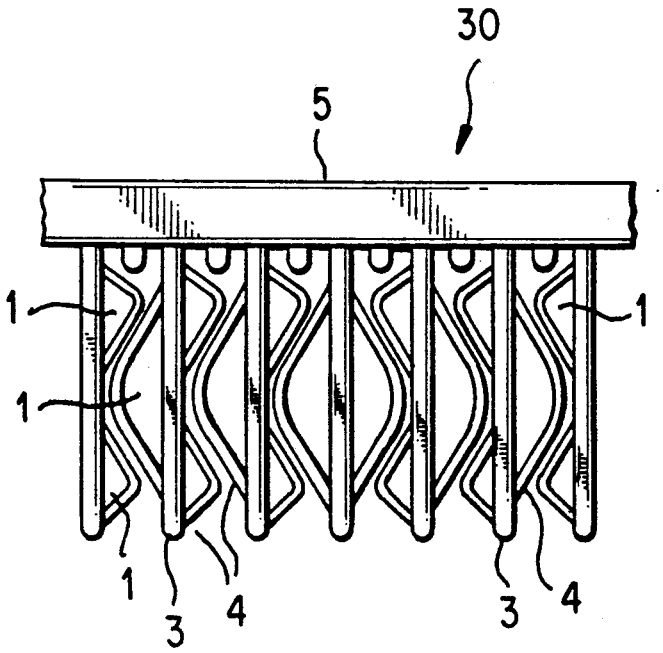
FIG. 3 is a front view of a first straight-backed hair comb according to an embodiment of the present invention.

FIG. 3 shows a straight-backed comb 30 in accordance with an embodiment of the present invention, having a straight back 5 rather than the curved back 20 of the comb shown in FIG. 1. However, the principle of operation of the straight-backed comb 30 is the same as the curved back comb 10 in FIG. 1.

Figure 4:
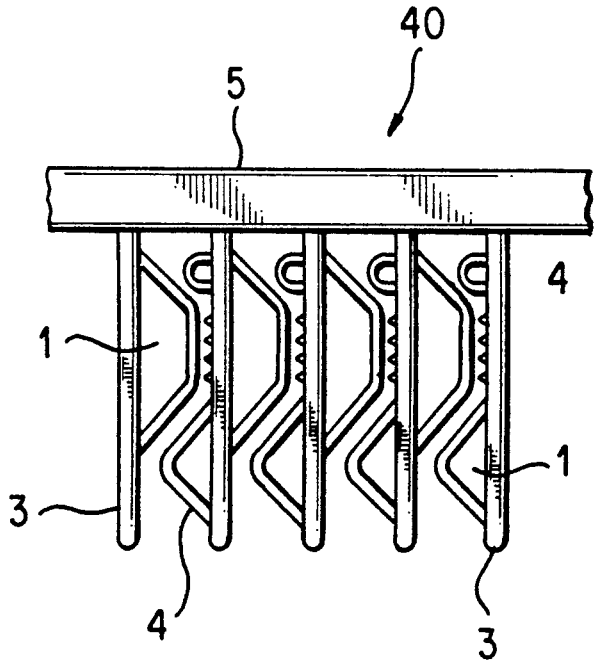
FIG. 4 is a front view of a second straight-backed hair comb according to an embodiment of the present invention.

FIG. 4 shows an alternative embodiment of a straight-backed comb 40 having a slightly different configuration for the leaf-springs 4.

Figure 5:
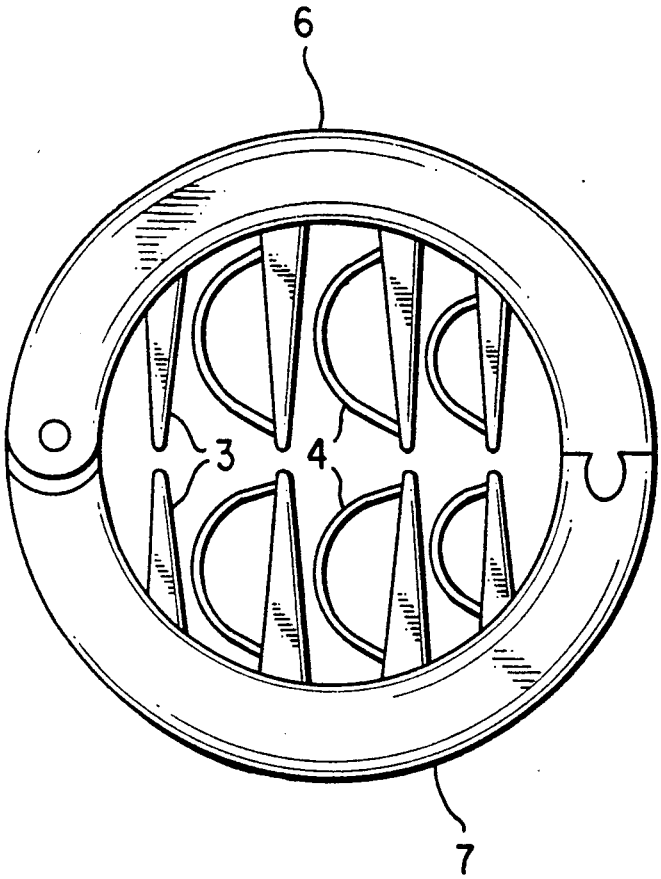
FIG. 5 is a front view of a circular hair fastening device according to an embodiment of the present invention.

FIG. 5 shows a circular hair pin 50 made in accordance with an embodiment of the present invention. The pin 50 comprises two pivoting semi-circular halves 6, 7, each having a set of teeth 3 and associated leaf springs 4. A clasp or locking mechanism 8 is provided such that the two semi-circular halves 6, 7 can be locked together after insertion of the device into a user's hair. The circular hair pin 50 operates in the same fashion as the embodiments discussed above, except that both of the semi-circular halves 6, 7 are inserted into the hair (for example, when used with a "pony tail").

Figure 6:
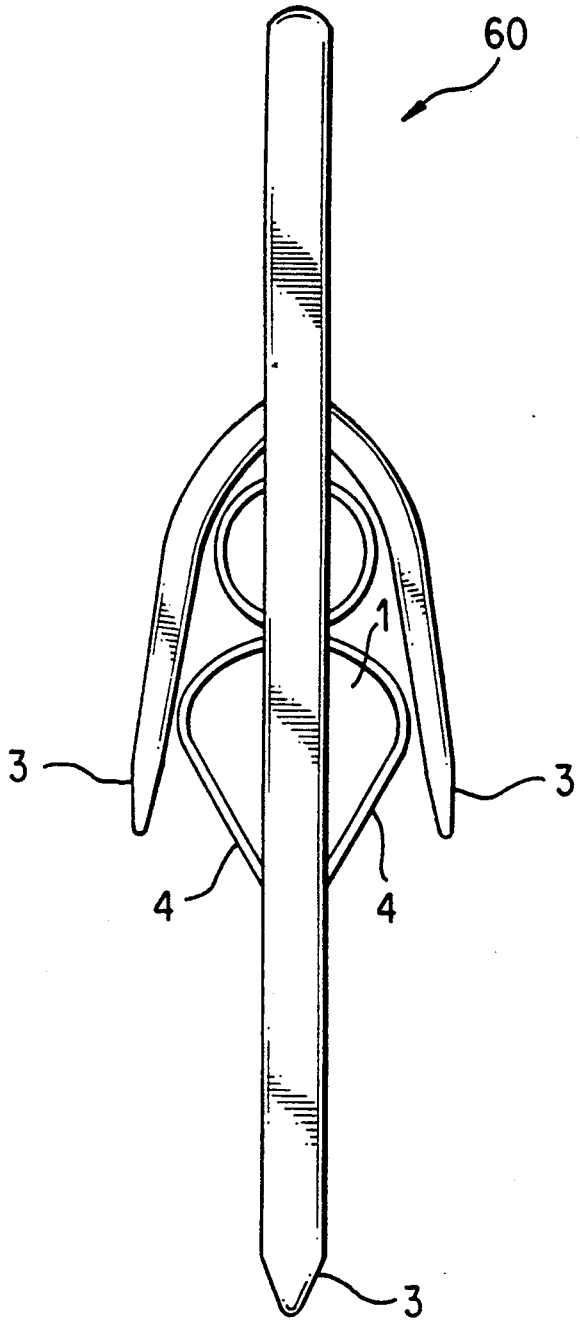
FIG. 6 is a front view of a chignon pin according to an embodiment of the present invention.

FIG. 6 shows a chignon pin 60 having teeth 3 and leaf-springs 4 made in accordance with an embodiment of the present invention. The teeth 3 of the chignon pin 60 may also be referred to as tines or prongs. Between at least some of the teeth 3 are leaf-springs 4 that function in the same manner as the leaf-springs 4 shown in the devices of FIGS. 1-5.

Figure 7:
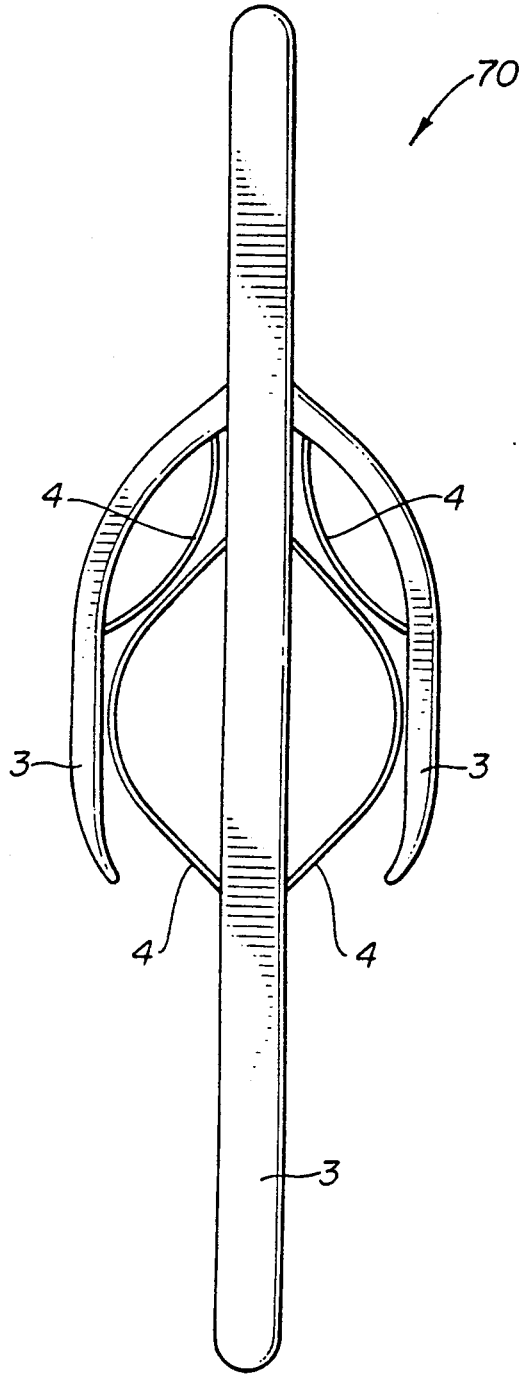
FIG. 7 is a front view of another chignon pin according to an embodiment of the present invention.

FIG. 7 shows a chignon pin 70 having teeth 3 similar to the teeth 3 of chignon pin 60 shown in FIG. 6. Specifically, teeth 3 comprise a relatively large central tooth 3 and a plurality (2 shown in FIG. 7) of smaller teeth 3 extending from the central tooth 3. Unlike the pin shown in FIG. 6, leaf-springs 4 are connected not only to the central tooth 3, but to the smaller teeth 3 as well. Specifically, each smaller tooth 3 is provided with a leaf-spring 4, while the central tooth 3 is provided with a plurality (2 in FIG. 7) of the leaf-springs 4. Each leaf-spring 4 extending from central tooth 3 is directed toward one of the smaller teeth 3 and toward the leaf-spring extending from that smaller tooth 3. The principle of operation of pin 70 is the same as pin 60 shown in FIG. 6. However, with the leaf-springs 4 arranged as shown in FIG. 7, hair may be clamped between two leaf-springs as well as between a leaf-spring and a tooth.

Figure 8:
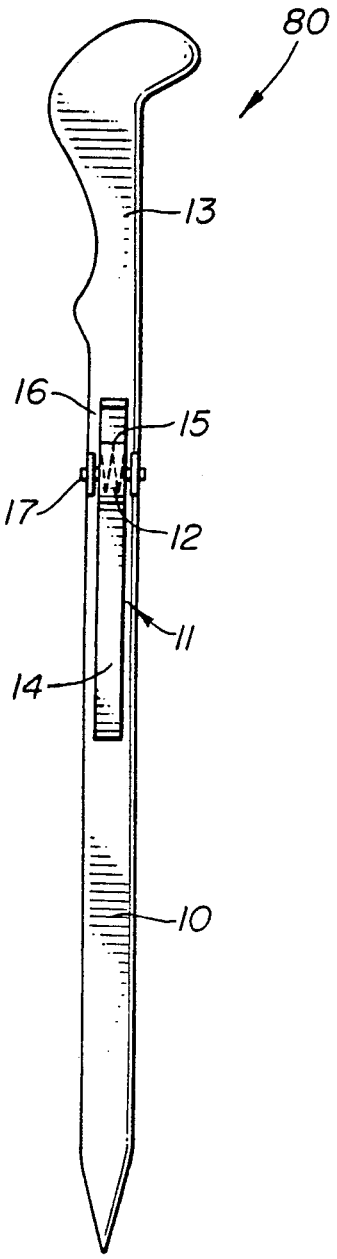
FIG. 8 is a front view of yet another chignon pin according to an embodiment of the present invention.
Figure 9:
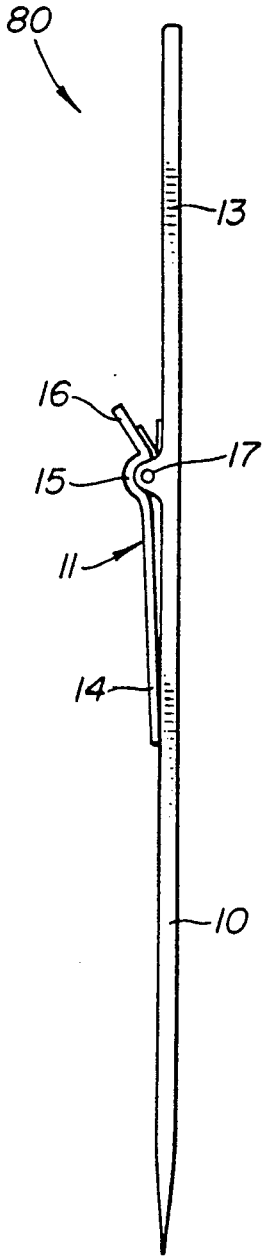
FIG. 9 is a side view of the chignon pin shown in FIG. 8.

FIGS. 8 and 9 show a front and side view, respectively, of a chignon pin 80 according to another embodiment of the invention. Pin 80 includes a tooth 10, a clamp 11 and a spring mechanism 12. In the illustrated embodiment, tooth 10 is substantially straight along its length and is provided with a curved end 13 which can operate as a handle for easily gripping and manipulating the pin. However, further embodiments may include a tooth 10 which is curved along a greater portion or its entire length or which is straight along its entire length.

Clip 11 comprises a substantially flat plate or strip having a flat portion 14 and a curved portion near one end (at 15) and which is bent away from tooth 10 at the same end (at 16). Clip 11 is pivotally attached to tooth 10 so as to pivot about a pivot point 17. A spring mechanism 12 is provided at pivot point 17 to urge the flat portion 14 of clip 11 toward tooth 10.

By pressing bent portion 16 towards tooth 10, clip 11 will pivot about pivot point 17 such that the flat portion 14 of clip 11 will be displaced in the direction away from tooth 10. Releasing bent portion 16 will cause clip 11 to displace back toward tooth 10, by virtue of the spring force provided by spring mechanism 12.

In operation, a user will push tooth 10 into the user's hair and, at the same time, will push down on bent portion 16 so as to displace the flat portion 14 of clip 11 away from tooth 10. As tooth 10 is pushed into the user's hair, some of the user's hair slides along tooth 10 to a position between tooth 10 and the flat portion 14 of clip 11 which is then displaced from tooth 10. By releasing bent portion 16, the flat portion 14 of clip 11 will be urged toward tooth 10 and will clamp the user's hair between the flat portion 14 of clip 11 and tooth 10.

Figure 10:
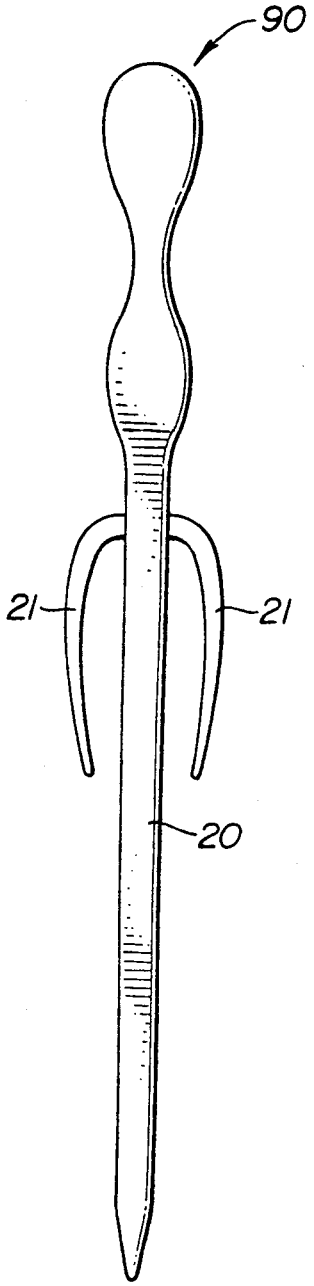
FIGS. 10 and 11 show two other embodiments of a chignon pin.
Figure 11:
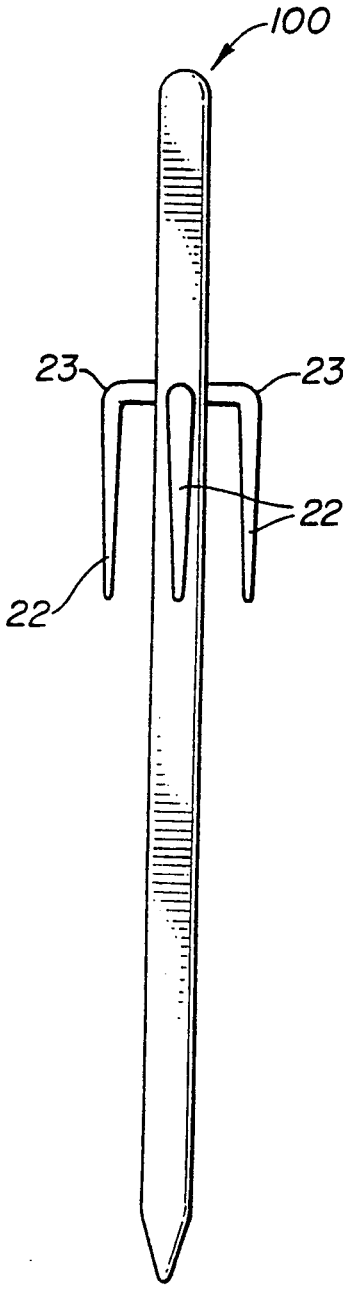

FIGS. 10 and 11 show two further embodiments of chignon pins 90 and 100, respectively. Chignon pin 90 shown in FIG. 10 includes a central tooth 20 and a plurality (2 shown in FIG. 10) of curved, smaller teeth 21 extending from central tooth 20. In an alternative embodiment, smaller teeth 21 may be relatively straight along portions of their length, such as shown in FIG. 11. The top portion of central tooth 20, with respect to FIG. 10, is curved to provide an ergonomic handle for gripping and manipulating pin 90. In further embodiments, leaf-springs may be extended from any one or combination of teeth 20 and 21. The principle of operation of pin 90 is similar to that of pin 70 shown in FIG. 7.

FIG. 11 shows an alternative embodiment of a chignon pin 100 having a configuration of at least three small teeth 22. Small teeth 22 are bent at a substantially 90° angle at 23 and extend substantially straight from the 90° bend. In further embodiments, a curved handle (such as shown in FIG. 10) may be employed. Further embodiments may include leaf-springs extending from any one or combination of the central tooth or teeth 22.

The above described embodiments of chignon pins may be characterized as having a tooth support structure comprising the handle or upper portion of the central tooth, a large tooth comprising the lower portion of the central tooth, and a plurality of smaller teeth.

Figure 12:
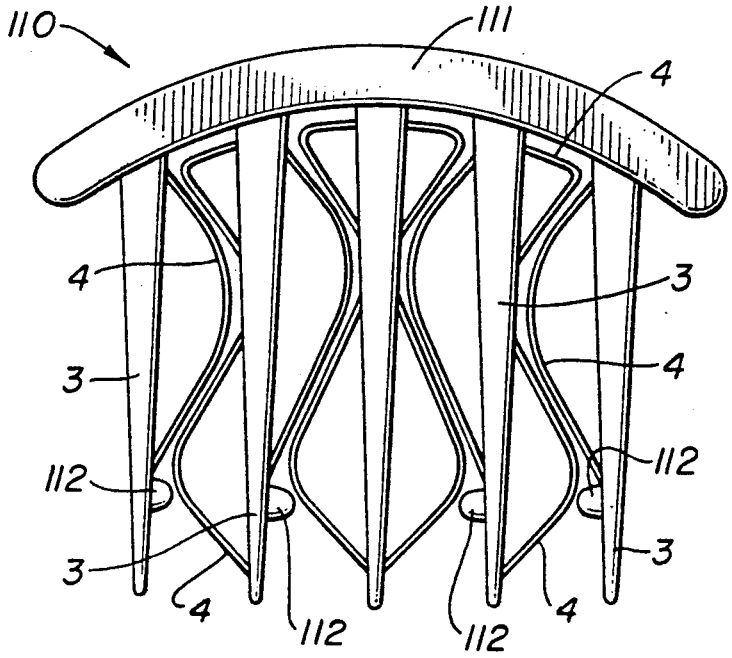
FIG. 12 is a front view of a curved back hair comb according to an embodiment of the present invention.

FIG. 12 shows a front view of curved-back hair comb 110 which includes several elements similar to elements shown with respect to FIG. 1. Such similar elements are provided with corresponding reference characters as comb 10 shown in FIG. 1. However, unlike FIG. 1, several of the comb teeth 3 are provided with protrusions 112 extending toward the center tooth of comb 110. Protrusions 12 provide an additional surface against which leaf-springs 4 may clamp hair. Furthermore, protrusions 112 inhibit hair clamped between leaf-springs 4 from slipping out of comb 112. In an alternative embodiment, comb 110 may have a straight back rather than the curved back 111 shown in FIG. 12.

Figure 13:
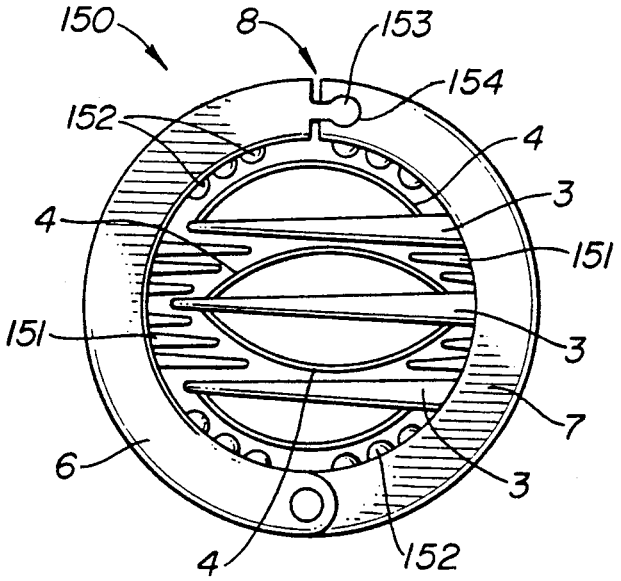
FIG. 13 is a front view of another circular hair fastening device according to an embodiment of the present invention.

FIG. 13 shows a circular hair pin 150 having several elements which are similar to elements of circular hair pin 50 shown in FIG. 5. Such similar elements are provided with reference characters corresponding to reference characters in FIG. 5. However, unlike the circular hair pin 50 of FIG. 5, circular hair pin 150 includes three larger teeth 3 arranged in a row, the middle tooth having two leaf-springs 4 extending from opposite sides thereof and toward the other teeth 3. Additionally, the end teeth each have a single leaf-spring extending away from the center tooth. A plurality of smaller teeth 151 extend from various locations between the larger teeth 3 and around the semi-circular halves 6 and 7 toward the center of the circular hair pin 150. Furthermore, several protrusions extend from semi-circular halves 6 and 7 toward the center of the circular hair pin and toward the leaf-springs 4 which extend from the two outer teeth 3. Protrusions 152 provide further surfaces against which hair may be clamped by leaf-springs 4.

A latch mechanism 8 is provided for securing halves 6 and 7 together in the closed, circular configuration shown in FIG. 13. When closed, halves 6 and 7 define a toroid-shaped body. The latch mechanism 8 includes a ball-shaped member 153 extending from half 6 and a socket 154 in half 7 Which is shaped to receive ball-shaped member 153.

In the preferred embodiments of the invention, the leaf-springs 4 are integrally molded as part of the teeth. However, if desired, the leaf-springs 4 can be separately manufactured, and affixed to the teeth in any desired fashion (for example, by heat welding, gluing, or ultrasonic bonding).

The illustrated embodiments show the leaf-springs 4 as being connected to a tooth at both ends of each spring 4. However, the leaf-springs 4 can be made such that they are not connected at one end to a tooth. In some uses, this may have the drawback of catching hair either upon insertion or withdrawal of a hair fastening device. In other uses, such a characteristic may be desirable.

Although some of the illustrated embodiments show leaf-springs 4 between each pair of teeth, it is not necessary that every pair of teeth have leaf-springs 4 situated therebetween. Further, the leaf-springs 4 may be formed attached to only one of a pair of teeth, as shown in FIGS. 5 and 6. In this configuration, the restorative spring force of the single leaf-spring 4 exerts a clamping force against the hair, pressing the hair against the adjacent opposing tooth.

A number of embodiments of the present invention have been described. Nevertheless, it will be understood that various modifications may be made without departing from the spirit and scope of the invention. For example, the spacing between adjacent paired leaf-springs 4, or between a single leaf spring 4 and an adjacent opposing tooth, can be varied as desired during manufacture to alter the clamping force exerted by the leaf-springs 4. The thickness of the leaf-springs 4 can also be varied during manufacture to alter the clamping force. Accordingly, it is to be understood that the invention is not to be limited by a specific illustrated embodiment, but only the scope of the appended claims.

I claim:

1. A hair fastening device including:

a. a support structure;

b. at least one tooth of a first length extending from the support structure;

c. at least one tooth of a second length extending from the support structure, the first length being greater than the second length;

d. at least one leaf spring attached to each tooth of the first length;

e. wherein the support structure includes a first substantially semicircular member and a second semicircular member pivotally attached to each other at an end of each substantially semicircular member so as to be pivotally moved to a closed position such that the substantially semicircular members form a circle; and f. wherein the teeth extend from at least one of the substantially semicircular members toward the inside of the circle formed by the substantially semicircular member.

2. The hair fastening device of claim 1, further comprising a latch mechanism for latching the substantially semicircular members in the closed position.

3. The hair fastening device of claim 2, wherein the latch mechanism includes a ball shaped member extending from one of the two substantially semicircular members and a socket in the other of the two substantially semicircular members and configured to receive the ballshaped member.

4. A hair fastening device comprising:

a. first and second substantially semicircular members pivotally connected to each other so as to be pivotally moveable to a closed position, wherein the two substantially semicircular members form a toroid-shaped body defining an open central portion when in the closed position;

b. a plurality of teeth extending from at least one of the first and second substantially semicircular members into the central portion of the toroid-shaped body formed by the substantially semicircular members when in the closed position; and c. at least one of the plurality of teeth having a leaf spring attached which extends toward another of the plurality of teeth.

5. The device of claim 4, wherein the plurality of teeth comprise a first tooth extending from the first substantially semicircular member, a second tooth arranged on one side of the first tooth and a third tooth arranged on the opposite side of the first tooth, the device further comprising a first leaf spring between the first and second teeth and a second leaf spring between the first and third teeth.

6. The device of claim 5, wherein the first and second leaf springs extend from the first tooth toward the second and third teeth, respectively.

7. The device of claim 5, further including a third leaf spring extending from the second tooth and a fourth leaf spring extending from the third tooth.

8. The device of claim 4, further including at least one leaf spring disposed between two of the plurality of teeth.

9. The device of claim 4, wherein the plurality of teeth comprise a first plurality of teeth of a first size and a second plurality of teeth of a second size, the second size teeth being smaller than the first size teeth.

10. The device of claim 9, wherein the second size teeth are disposed between the first size teeth.

11. The device of claim 4, further including:

a. at least one leaf spring disposed between at least one tooth and the toroid-shaped body formed by the substantially semicircular members when in the closed position; and b. at least one protrusion extending from the toroid-shaped body toward and adjacent to at least one leaf spring for clasping hair passing between the protrusion and the leaf spring.

* * * * *